US006066001A

United States Patent [19]

Liptak et al.

[11] Patent Number: 6,066,001

[45] Date of Patent: May 23, 2000

[54] COUPLER FOR MINIMIZING EMI EMISSIONS

[75] Inventors: John Michael Liptak, Marblehead; Brian Bisceglia, Holden, both of Mass.

[73] Assignee: 3Com Corporation, Santa Clara, Calif.

[21] Appl. No.: 09/200,883

[22] Filed: Nov. 30, 1998

[51] Int. Cl.[7] ..... H01R 13/648

[52] U.S. Cl. ..... 439/607; 439/609; 439/108; 439/939; 439/95

[58] Field of Search ..... 439/607, 609, 439/108, 939, 95

[56] References Cited

U.S. PATENT DOCUMENTS

| | | | |
|---|---|---|---|
| 3,065,035 | 11/1962 | Biesecker | 348/296 |
| 4,386,814 | 6/1983 | Asick | 339/14 |
| 4,737,888 | 4/1988 | Bodnar et al. | 361/427 |
| 5,112,251 | 5/1992 | Cesar | 439/607 |
| 5,607,323 | 3/1997 | Foster et al. | 439/557 |
| 5,738,544 | 4/1998 | Davis | 439/607 |
| 5,772,471 | 6/1998 | Buck | 439/607 |
| 5,800,208 | 9/1998 | Ishizuka et al. | 439/557 |
| 5,803,758 | 9/1998 | Kameyama | 439/248 |
| 5,807,125 | 9/1998 | Edgley et al. | 439/248 |
| 5,865,646 | 2/1999 | Ortega et al. | 439/607 |
| 5,934,913 | 8/1999 | Kodama | 439/76.1 |

*Primary Examiner*—Paula Bradley
*Assistant Examiner*—Truc Nguyen
*Attorney, Agent, or Firm*—Weingarten, Schurgin, Gagnebin & Hayes LLP

[57] ABSTRACT

A conductive coupler electrically couples a conductive housing of an electronic device, such as a transceiver, to a conductive bulkhead in a reliable manner such that the electronic device is accessible through an opening in the bulkhead and a low impedance connection between the housing and the bulkhead is assured. The disclosed coupler comprises a conductive sleeve and tabs which are formed so as to capture the bulkhead between cooperative tabs when the coupler is urged into a mounting position. When the coupler is disposed in the mounting position a low impedance electrical connection between the coupler and the bulkhead is provided. The device includes resilient conductive members which extend outward from the device housing. The conductive members are urged against the interior surface of the sleeve and electrically couple the conductive housing of the device to the coupler when the device is disposed within the sleeve in a device mounting position.

11 Claims, 3 Drawing Sheets

COUPLER FOR MINIMIZING EMI EMISSIONS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a method and apparatus for minimizing electro-magnetic interference and more particularly to a coupler for reliably coupling a conductive housing of an electronic device to a bulkhead via a low impedance path to reduce EMI emissions.

It is desirable to minimize electro-magnetic interference (EMI) emanating from electronic devices to prevent interference with other electronic devices. In this regard, The Federal Communications Commission has promulgated standards which govern acceptable levels of EMI. Compliance with such standards has been difficult to achieve in certain applications. More specifically, while it is understood that EMI may be reduced through the use of appropriate shielding techniques, the mechanical requirements for the electronic equipment in certain applications can make compliance with the applicable standards problematic.

For example, in telecommunications equipment, such as bridges, routers and switches, transceivers are typically provided to allow for the connection of the equipment to networks via port connectors. The port connectors of the transceivers are typically accessible through openings provided within a bulkhead or chassis metalwork. Such openings have been determined to be the source of undesirable EMI emissions. In an effort to minimize EMI emissions, the electronic components of some transceivers, such as gigabit optical transceivers, are enclosed within a conductive housing. Gigabit optical transceivers are commercially available from Hewlett Packard Company, Santa Clara, Calif. 95054 and Optical Communication Products, Inc, Chatsworth, Calif. 91311 and identified as model numbers HFBR53D5EM and DTR1250MMES respectively. The above referenced optical transceivers are provided in a standard 1×9 Single Inline Package (SIP) configuration. In such commercially available optical transceivers, conductive members are provided which are electrically coupled to the conductive housing and extend from the housing. The conductive members are intended to be grounded to surrounding metalwork to minimize EMI emissions.

The gigabit optical transceivers include two port connectors for mating with corresponding connectors adapted for coupling to input and output cables respectively. Though efforts to ground the transceiver housings to surrounding metalwork have been made, EMI emissions at such bulkhead openings at objectionable levels have been measured notwithstanding such efforts.

Accordingly, it would be desirable to be able to reliably couple the conductive housing of a transceiver or other electrical device to a bulkhead while permitting access to connectors or controls associated with such a transceiver or device in a manner which minimizes EMI emissions in the vicinity of the bulkhead opening.

BRIEF SUMMARY OF THE INVENTION

A coupler is disclosed for electrically coupling a conductive housing of a transceiver or other electronic device to a conductive bulkhead while providing access to the device through an opening provided within the bulkhead. In a preferred embodiment, the coupler comprises a conductive metal sleeve sized to permit the sleeve to be mounted to the bulkhead such that an opening defined by the sides of the sleeve extends through the opening provided in the bulkhead. The sleeve in a preferred embodiment is fabricated as a formed metal part and has tabs extending from at least two sides of the sleeve. The tabs serve to fixably mount the sleeve to the bulkhead when the sleeve is disposed in a mounting position. When the sleeve is disposed within the mounting position, the tabs of the sleeve serve to electrically couple the sleeve to the bulkhead via a low impedance electrical connection.

In one embodiment, the coupler is employed to electrically couple a conductive housing of an optical transceiver to the conductive bulkhead. The optical transceiver includes input and output port connectors for mating with corresponding port connectors coupled to input and output signal cables respectively. The optical transceiver includes resilient conductive members which are electrically coupled to the conductive housing of the transceiver and which extend from the housing. The sleeve opening is selectively sized to receive the optical transceiver and the optical transceiver is insertable within the sleeve opening such that the resilient conductive members of the transceiver are urged into conductive abutting relation with the interior surface of the sleeve. A low impedance electrical contact between the resilient members and the interior surface of the sleeve in thus provided so as to electrically couple the transceiver housing to the coupler.

In the foregoing manner, the conductive device housing is conductively coupled to the bulkhead in a manner which reliably provides a low impedance electrical connection between the housing and the bulkhead so as to minimize EMI emissions in the vicinity of the bulkhead opening.

BRIEF DESCRIPTION OF THE SEVERAL VIEWS OF THE DRAWING

The invention will be more fully understood by reference to the following Detailed Description of the Preferred Embodiments in conjunction with the following drawings of which.

DETAILED DESCRIPTION OF THE PREFERRED EMBODIMENTS

In accordance with the present invention, a coupler is disclosed for electrically coupling a conductive housing of an electronic device such as a transceiver to a conductive bulkhead while providing access to the device through openings in the coupler and bulkhead respectively. The disclosed coupler assures that a reliable electrical contact is made between the housing of the electronic device and the bulkhead so as to minimize EMI emissions from the bulkhead opening. In a preferred embodiment, the electronic device comprises a gigabit optical transceiver such as identified hereinabove above.

Figure 1:
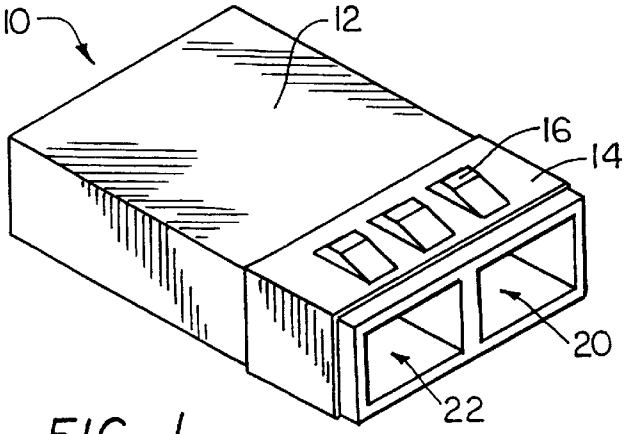
FIG. 1 PRIOR ART
FIG. 1 is a perspective view of an optical transceiver as known in the art.

A prior art gigabit optical transceiver is depicted in FIG. 1. The optical transceiver 10 includes a conductive housing 12. The conductive housing 12 is fabricated of a conductive material to provide EMI shielding for the electronic components mounted within the housing which emit EMI when operated at high switching speeds. The optical transceiver 10 includes a sheet metal shroud 14 which is in conductive abutting relation with the housing 12. The shroud 14 is fabricated of sheet metal and includes resilient members 16 which are integral with the shroud 14 and extend therefrom. The transceiver 10 includes input and output port connectors 20 and 22 respectively, for mating with corresponding connectors on respective input and output cables (not shown).

Figure 2:
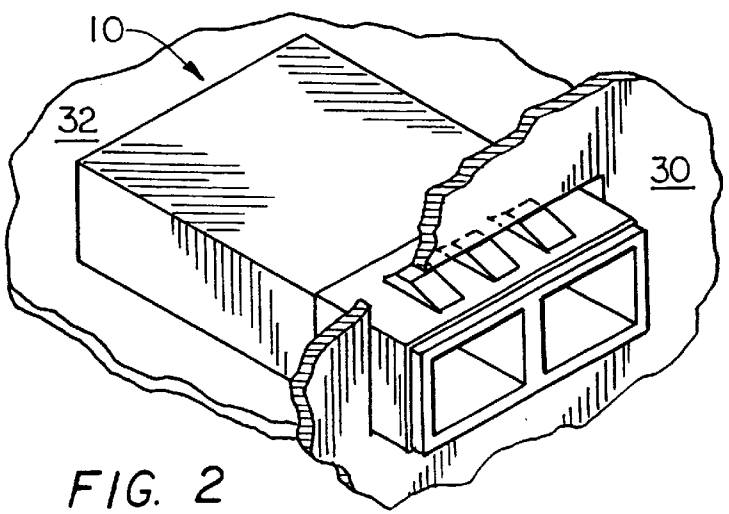
FIG. 2 PRIOR ART
FIG. 2 is a perspective view of the optical transceiver of FIG. 1 extending through a bulkhead opening as known in the art.

FIG. 2 illustrates a prior art assembly in which the input and output port connectors 20 and 22 of the transceiver 10 are accessible through an opening in a bulkhead 30. As illustrated in FIG. 2, the transceiver 10 is mounted to a printed circuit board 32. Electrical contacts (not shown) located on the underside of the transceiver 10 are in electrical communication with electrical contacts (not shown) on the printed circuit board 32 and serve to connect the transceiver to other electronic components. The circuit board 32 is mountable in a mounting position with respect to the bulkhead 30 such that the port connectors 20, 22 of the transceiver 10 are accessible through the opening within the bulkhead 30. The opening within the bulkhead 30 is sized with respect to the frontal end of the transceiver 10 such that the resilient members 16 are urged into abutting relation with at least one edge of the bulkhead 30 so as to conductively couple the transceiver housing 12 to the bulkhead 30.

It has been observed that EMI emissions measured at bulkhead openings having optical transceiver housings 12 coupled to the bulkhead 30 in the above-described manner have not always resulted in EMI emissions as low as desired. Such is due to several factors. First, the openings within the bulkhead 30 are typically formed via a metal stamping technique. This technique leaves a comparatively rough unfinished edge at the opening. Accordingly, when the resilient members 16 come in contact with the rough edge of the opening within the bulkhead 30, the actual surface area contacted by the members 16 at the edge of the opening 30 is dependent upon the nature of the surface at the edge of the opening. Additionally, since the bulkhead comprises sheet metal oriented orthogonally to the upper surface of the transceiver housing 12, the resulting capacitance between the bulkhead opening edge and the transceiver housing 12 is quite small. It has been observed that ineffective electrical coupling between the transceiver housing and the bulkhead can result in undesirably high EMI emissions.

Figure 3A:
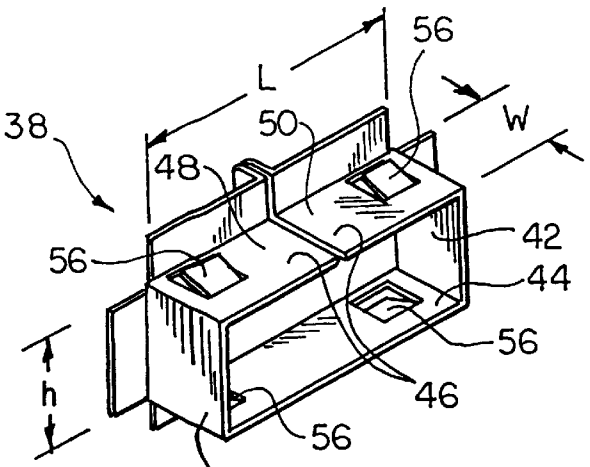
FIG. 3A is a first perspective view of a coupler for electrically coupling an optical transceiver to a bulkhead.
Figure 3B:
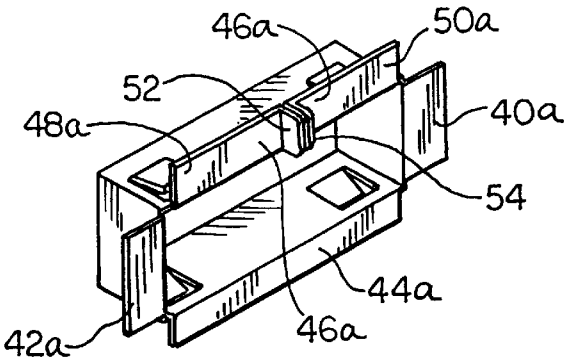
FIG. 3B is a second perspective view of the coupler of FIG. 3A.

The presently disclosed coupler is depicted in FIGS. 3A and 3B. In the preferred embodiment depicted in FIGS. 3A and 3B, the coupler 38 is fabricated as an integral sheet metal part comprising 0.008 inch thick, ¼ hard, 301 stainless steel. The coupler 38 includes a sleeve portion having first and second opposing sides 40 and 42 respectively and third and fourth opposing sides 44 and 46 respectively which define an opening in the sleeve sized to receive the optical transceiver 10 as hereinafter discussed. The side 46 comprises first and second side portions 48 and 50 respectively which abut one another generally at the center of the side 46 of the sleeve.

Figure 6:
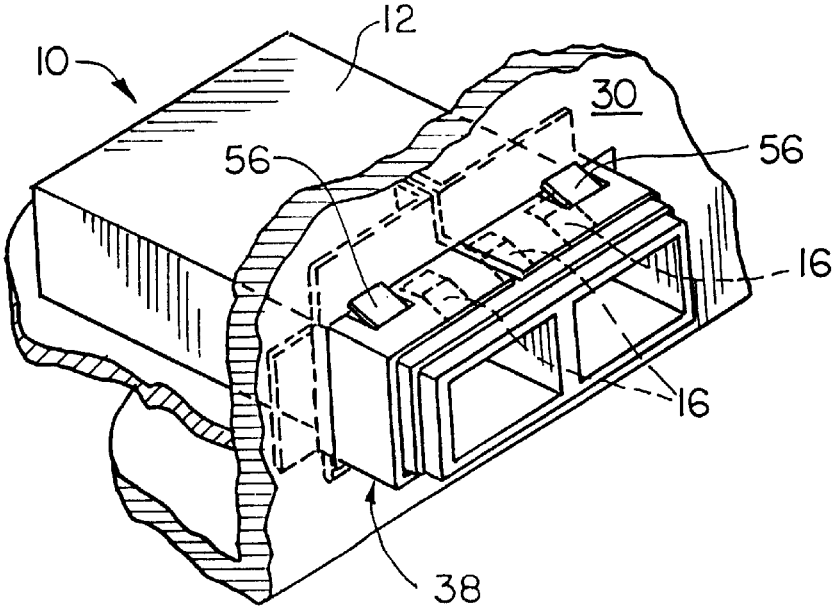
FIG. 6 is a perspective view illustrating the assembled coupler assembly including the transceiver, coupler and bulkhead.

The sleeve of the coupler 38 has a height h and a length l which are selected to permit the device 10 to be slidably disposed into the sleeve (See FIG. 6). Additionally, the sleeve has a width W which is specified to assure that the members 16 of the device 10 are disposed within the sleeve opening when the device 10 is disposed within the sleeve in a mounting position.

Figure 4:
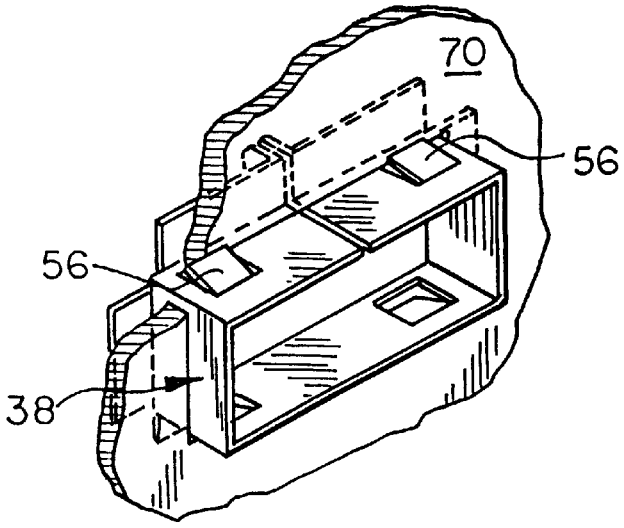
FIG. 4 is a perspective view of the coupler of FIGS. 3A and 3B mounted within a bulkhead opening.

The coupler further includes a number of integral conductive tabs which serve to capture the bulkhead between selected ones of the tabs to fixably mount the coupler 38 to the bulkhead 30 in a coupler mounting position as illustrated in FIG. 4. When so mounted, the tabs reliably provide a low impedance electrical contact between the coupler 38 and the bulkhead 30.

More specifically, the coupler 38 includes integral conductive edge tabs 40*a*, 42*a*, 44*a* and 46*a* which extend from the edges of respective sleeve sides and which abut the bulkhead 30 surface in conductive relation when the coupler 38 is mounted to the bulkhead 30 in the coupler mounting position. The edge tab 46*a* comprises first and second edge tab portions 48*a* and 50*a*. Additionally, conductive flanges 52 and 54 extend generally perpendicularly from edge tabs 48*a* and 50*a* respectively and are integrally formed with the edge tabs. The flanges 52 and 54 are in generally abutting relation so as to prevent the sleeve side portions 48 and 50 from collapsing over one another upon installation and mounting of the coupler 38 within the bulkhead 30.

The coupler 38 further includes side tabs 56 which extend outward from opposing sides 44, 46 of the sleeve. Though the sleeve is illustrated as having tabs 56 extending from the third side 44 and the fourth side 46 it should be appreciated that the tabs may alternatively be located on the first side 40 and the second side 42 or on all sides of the sleeve. The side tabs 56 in the presently disclosed embodiment define an interior angle beta (B) with the respective side of the sleeve and are positioned on the side such that the horizontal distance "d" between the ends 47 of the edge tabs 44*a*, 46*a* and the ends 56*a* of the side tabs 56 is slightly less than the thickness of the bulkhead 30. To mount the coupler to the bulkhead the edge tabs 40*a*, 42*a*, 44*a*, 46*a* are urged against the bulkhead surface and deformed slighly so as to increase the distance d to accomodate the bulkhead thickness. The deformation of the edge tabs and the corresponding increase in the distance d allows the side tabs 56 to pop up and capture the bulkhead between the edge tabs 44*a*, 46*a* and the ends 47 of the side tabs 56.

Figure 3C:
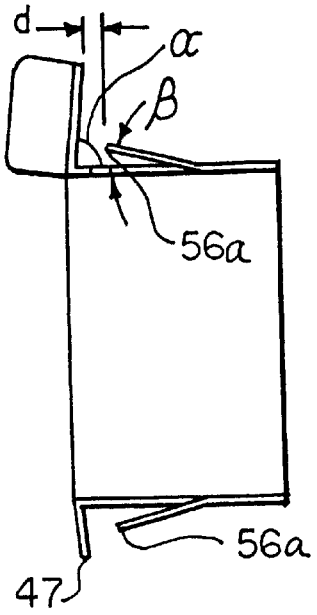
FIG. 3C is a side view of the coupler of FIG. 3A.

Edge tabs 40*a* 42*a*, 44*a* and 46*a* define an acute interior angle ($\alpha$) with respective sides 40, 42, 44 and 46 as depicted in FIG. 3C. In the preferred embodiment, the interior angle is specified to be 87 degrees, plus or minus 2 degrees.

By providing the spacing d (FIG. 3C) between opposing tab ends slightly less than the thickness of the bulkhead 30, when the sleeve is inserted into the bulkhead opening such that edge tabs are urged against the bulkhead, as depicted in FIG. 6, the bulkhead is captured in a mounting position between the edge tabs 46*a*, 44*a* and the side tabs 56 extending from the respective sides. Thus, a large contact is obtained between the surface of the edge tabs 40*a*, 42*a*, 44*a*, 46*a* and the opposing surface of the bulkhead 30 so as to reliably provide a low electrical impedance between the coupler 38 and the bulkhead 30. Moreover, due to the comparatively smooth surface of the edge tabs 40*a*, 42*a*,

44*a*, 46*a* and the bulkhead surface (as opposed to the edge of the opening), a low impedance contact is assured.

Figure 5:
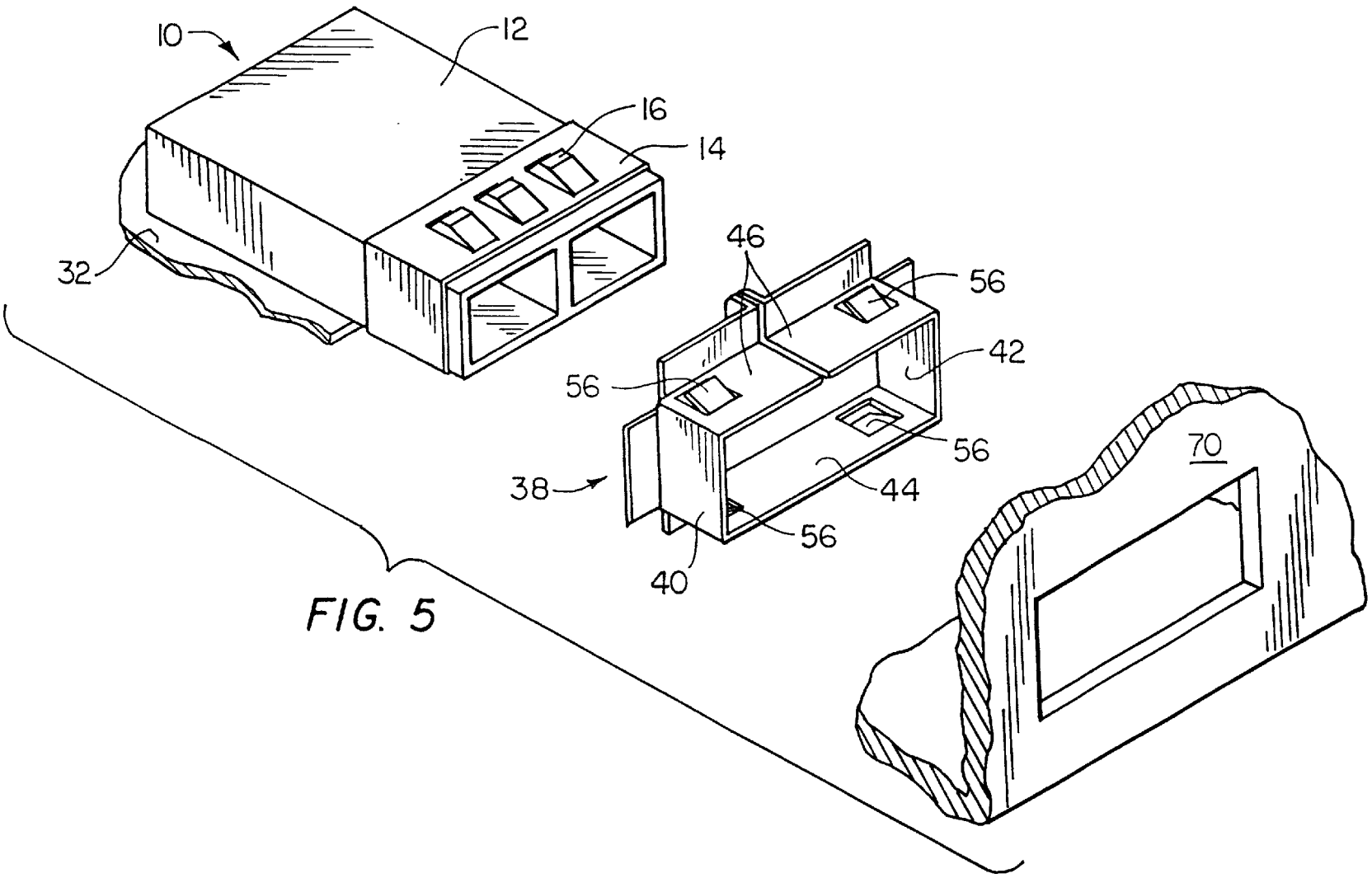
FIG. 5 is an exploded perspective view illustrating the transceiver, the coupler and the bulkhead prior to assembly.

The components of the coupler assembly are illustrated in an exploded view in FIG. 5 and include the electronic device 10, comprising a gigabit optical transceiver in a preferred embodiment, the coupler 38 and a partial portion of the bulkhead 30. While a portion of the bulkhead 30 is depicted, it should be understood that such is intended to depict any chassis or metalwork having as opening sized to permit through access to an electronic device in the manner described.

FIG. 6, depicts the coupler assembly in assembled form with the coupler 38 mounted to the bulkhead 30 in the mounting position hereinabove described and the device 10 inserted within the coupler 38 such that the resilient conductive members 16 are urged into mechanical conductive contact with the interior surface of the sleeve.

It will be understood to those of ordinary skill in the art that variations to and modifications of the above described coupler and coupler assembly may be made without departing from the inventive concepts disclosed herein. Accordingly, the invention is not to be viewed as limited by the embodiments disclosed herein but rather, solely by the scope and spirit of the appended claims.

What is claimed is:

1. An electrical coupling system for reducing electromagnetic interference (EMI) emissions comprising:

an electronic device having a frontal cross section and an electrically conductive housing with at least one electrically conductive member conductively coupled to said electronic device housing and extending from said electronic device housing;

an electrically conductive bulkhead having at least one opening therethrough; and an electrical coupler comprising:

an electrically conductive sleeve having a sleeve cross-section generally corresponding in shape to said frontal cross section of said electronic device, said sleeve having external and interior surfaces, said sleeve cross section having dimensions specified to permit said electronic device to be insertable within said sleeve such that said at least one electrically conductive member is in conductive abutting relation with said interior surface when said electronic device is disposed at least partially within said sleeve in a device mounting position; and a plurality of electrically conductive tabs conductively coupled to said sleeve and extending from said sleeve, said tabs being selectively positioned and spaced so as to capture said bulkhead between selected ones of said tabs when said coupler is disposed in said bulkhead opening in conductive abutting relation with said bulkhead in a bulkhead mounting position;

said electrical coupler being mounted within one of said at least one opening of said conductive bulkhead and said electronic device being mounted within said electric coupler in said device mounting position so as to conductively couple said electronic device housing to said conductive bulkhead.

2. The electrical coupling system of claim 1 wherein said sleeve has four generally planar sides defining a sleeve of generally rectangular cross section.

3. The electrical coupling system of claim 2 wherein one of said sides is comprised of first and second separate side portions.

4. The electrical coupling system of claim 3 wherein said first and second separate side portions include respective first and second side edge tab portions and said side edge tab portions include respective first and second flanges extending generally perpendicularly from an edge of the respective first and second side edge tab portions such that said first and second flanges are in generally abutting relation.

5. The electrical coupling system of claim 1 wherein said sleeve and tabs comprise an integral metal part.

6. The electrical coupling system of claim 5 wherein said integral metal part comprises an integral stainless steel sheet metal part.

7. The electrical coupling system of claim 2 wherein said plurality of tabs comprises at least one edge tab and at least one side tab extending from and in electrical communication with each side of at least one pair of opposing sides of said sleeve.

8. The electrical coupling system of claim 7 wherein at least one of said edge tabs extends generally along the full length of the respective side.

9. The electrical coupling system of claim 8 wherein each of said edge tabs forms a first acute angle between the respective edge tab and the respective side.

10. The electrical coupling system of claim 9 wherein said first acute angle comprises an angle of approximately 87 degrees.

11. The electrical coupling system of claim 9 wherein each one of said side tabs forms a second acute angle with the respective side and the second acute angle is smaller than said first acute angle.

* * * * *

UNITED STATES PATENT AND TRADEMARK OFFICE

CERTIFICATE OF CORRECTION

PATENT NO. : 6,066,001
DATED : May 23, 2000
INVENTOR(S) : John Michael Liptak, et al.

It is certified that error appears in the above-identified patent and that said Letters Patent is hereby corrected as shown below:

Column 6,
Line 15, "claim 2", should read -- claim 7 --.

Signed and Sealed this

Sixth Day of November, 2001

*Attest:*

Nicholas P. Godici

NICHOLAS P. GODICI
*Acting Director of the United States Patent and Trademark Office*

*Attesting Officer*